United States Patent [19]

Hearn et al.

[11] Patent Number: 5,060,676

[45] Date of Patent: Oct. 29, 1991

[54] PROCESS FOR MAKING A CARBON HEAT SOURCE AND SMOKING ARTICLE INCLUDING THE HEAT SOURCE AND A FLAVOR GENERATOR

[75] Inventors: John R. Hearn, Chesterfield; Vincent Lanzillotti, Midlothian; George H. Burnett, Richmond, all of Va.

[73] Assignee: Philip Morris Incorporated, New York, N.Y.

[21] Appl. No.: 115,640

[22] Filed: Oct. 26, 1987

Related U.S. Application Data

[63] Continuation of Ser. No. 843,930, Mar. 24, 1986, abandoned, which is a continuation of Ser. No. 450,247, Dec. 16, 1982, abandoned.

[51] Int. Cl.[5] ..... A24D 1/18; A24B 15/16; A24B 15/18

[52] U.S. Cl. ..... 131/369; 131/359; 131/194

[58] Field of Search ..... 131/194, 359, 369, 197, 131/198, 274

[56] References Cited

U.S. PATENT DOCUMENTS

| | | | |
|---|---|---|---|
| 2,907,686 | 10/1959 | Siegel | 131/359 |
| 3,516,417 | 4/1968 | Moses . | |
| 3,608,560 | 9/1971 | Briskin . | |
| 3,625,228 | 12/1971 | Dock . | |
| 3,738,374 | 6/1973 | Bennett . | |
| 3,818,915 | 6/1974 | Anderson . | |
| 3,861,401 | 2/1975 | Briskin et al. . | |
| 3,913,590 | 10/1975 | Sway . | |

(List continued on next page.)

FOREIGN PATENT DOCUMENTS

| | | | |
|---|---|---|---|
| 276250 | 1/1964 | Australia . | |
| 769468 | 10/1967 | Canada . | |
| 787688 | 6/1988 | Canada . | |
| 0074201 | 3/1983 | European Pat. Off. . | |
| 2469133 | 1/1981 | France . | |
| 23980 | 10/1968 | Japan . | |
| 64/0060 | 1/1964 | South Africa . | |
| 1033674 | 2/1966 | United Kingdom . | |
| 1113979 | 5/1968 | United Kingdom . | |
| 1185887 | 3/1970 | United Kingdom | 131/359 |
| 1481056 | 3/1977 | United Kingdom . | |
| 2064293 | 9/1980 | United Kingdom . | |

OTHER PUBLICATIONS

Thakur and Brown, *The Pyrolysis of a Wyoming Coal in Different Nonreactive Atmospheres*, Carbon, vol. 20, No. 1, p. 17 (1982).

Mackay and Roberts, *The Dependence of Char and Carbon Yield on Lignocellulosic Precursor Composition*, Carbon, vol. 20, No. 2, p. 87 (1982).

Mackay and Roberts, *The Influence of Pyrolysis Conditions on Yield and Microporosity of Lignocellulosic Chars*, Carbon, vol. 20, No. 2, p. 95 (1982).

Grosser, *A Study of the Effects of* $Li^+$, $K^+$, $Na^+$, $Ca^{++}$, and $Mg^{++}$ and Their Salts on Flameless Combustion, Aug. (1967).

Youssef, Ghazy and El-Nabarwy, *Moisture Sorption by Modified Activated carbons*, Carbon, vol. 20, No. 2, p. 113 (1982).

*Primary Examiner*—V. Millin

*Attorney, Agent, or Firm*—Robert M. Isackson

[57] ABSTRACT

The present invention relates to a process for producing a tasteless carbon heat source from a preformed article of a ligno-cellulosic material according to which the article is pyrolyzed in a continuously exchanged inert atmosphere at a temperature within the range of from about 800° to about 1100° C., for from about 0.5 to about 3 hours, then cooled in the inert atmosphere at a rate of from about 500° to about 10° C. per hour to a temperature within the range of from about 275° C. to about 25° C., and then subjected to at least one additional process step selected from an oxygen absorption step, a salt impregnation followed by heat treatment step, and a water desorption step. The present invention also relates to a smoking article including the carbon heat source, and a flavor generator comprising a substrate material containing at least one thermally releasable flavorant.

45 Claims, 1 Drawing Sheet

U.S. PATENT DOCUMENTS 3,943,941 3/1976 Boyd et al. .
3,972,335 8/1976 Tiggelbeck et al. ..... 131/274
4,019,521 2/1977 Briskin .
4,079,742 3/1978 Rainer et al. .
4,133,317 11/1979 Briskin .
4,219,031 8/1980 Rainer et al. .
4,219,032 8/1980 Tabatznik et al. .
4,256,123 3/1981 Lendvay et al. .
4,256,126 3/1981 Seligman et al. ..... 131/359
4,286,604 9/1981 Ehretsmann et al. .
4,340,072 7/1982 Boyd et al. .
4,340,072 7/1982 Bolt et al. ..... 131/359
4,481,958 11/1984 Rainer et al. .
4,481,958 11/1984 Rainer et al. .
4,596,259 6/1986 White et al. .
4,600,025 7/1986 Grigg et al. .

PROCESS FOR MAKING A CARBON HEAT SOURCE AND SMOKING ARTICLE INCLUDING THE HEAT SOURCE AND A FLAVOR GENERATOR

This is a continuation, of application Ser. No. 06/843,930, filed Mar. 24, 1986, now abandoned, which is a continuation of Ser. No. 06/450,247, filed Dec. 16, 1982 now abandoned, entitled PROCESS FOR MAKING A CARBON HEAT SOURCE AND SMOKING ARTICLE INCLUDING THE HEAT SOURCE AND A FLAVOR GENERATOR.

BACKGROUND OF THE INVENTION

The present invention relates to a process for making a carbon source and to a smoking article comprising the carbon source and a flavor generator. More particularly, the present invention relates to a process for producing a carbon source from a preformed ligno-cellulosic material and to a smoking article, such as a cigarette, which includes the carbon source and a flavor generator.

One previously disclosed smoking article comprises a tube formed of combustible material which has a mouthpiece attached at one end. An axial inner tube of material, which is breakable when heated, is contained within the tube of combustible material and is coated on its inner surface with an additive material such as nicotine. Thus, on smoking, hot gases are drawn through the inner tube and release the nicotine in the form of an aerosol for inhalation by the smoker. With this device, however, there is an appreciable loss of nicotine and other desirable compounds, such as flavorants, during smolder. There is also a tendency for the inner tube to protrude unattractively from the burning end during smoking.

Another such cigarette-simulating smokeable device for releasing an aerosol into the mouth of a smoker comprises a rod of fuel having a longitudinally extending passage therethrough and a chamber in gaseous communication with an end of the passage whereby during smoking hot gases from the burning fuel rod enter the chamber. Inhalant material is located in the chamber which, when contacted by the hot gases during smoking, forms an aerosol for inhalation by the smoker. The chamber has, at an end remote from the fuel rod, a mouth-end closure member which is permeable to the aerosol. The chamber and the mouth-end closure member of this smoking article are of unitary construction and are formed by molding or extruding a conventional smoke filter plug to provide a chamber to contain the inhalant material. Preferably, the fuel rod is a molding or extrusion of reconstituted tobacco and/or tobacco substitute. The wall of the fuel rod is preferably impermeable to air.

The inhalant, or flavor-containing material, may comprise nicotine source material or spray-dried granules of flavorant whose composition lies within the range of from 10–100%, but preferably 30–60%, by weight of a solution of flavorant in triacetin or benzylbenzoate encapsulated in 10–70%, preferably 40–70%, by weight of gum acacia or a modified starch. The inhalant material may further comprise microcapsules formed by the coacervation method. The capsules comprise 10–90%, preferably 50–80%, by weight of flavorant in gum acacia, gelatin, or a mixture thereof.

SUMMARY OF THE INVENTION

The present invention relates to a process for producing a carbon heat source which is substantially tasteless when fabricated as a smoking article and smoked. According to this process, a preformed ligno-cellulosic material is pyrolyzed in a continuously exchanged inert atmosphere at a temperature within the range of from about 800° to about 1100° C., preferably from about b 950° to about 1000° C., for from about 0.5 to about 3 hours, preferably from about 0.5 to about 1.5 hours, then cooled in the inert atmosphere at an average rate of from about 500° to about 10° C. per hour, preferably at the rate of from about 100° to about 60° C. per hour, to a temperature within the range of from about 275° C. to about 25° C., and then subjected to at least one additional process step selected from oxygen absorption, water desorption, and impregnation with a salt solution followed by heat treatment.

The present invention also relates to a smoking article having a mouth end and a coal end and which comprises a carbon heat source produced according to the process of the present invention, and a flavor generator comprising a substrate material adjacent the mouth end which is impregnated with or inherently contains at least one thermally releasable flavorant.

DESCRIPTION OF PREFERRED EMBODIMENTS

Figure 1:
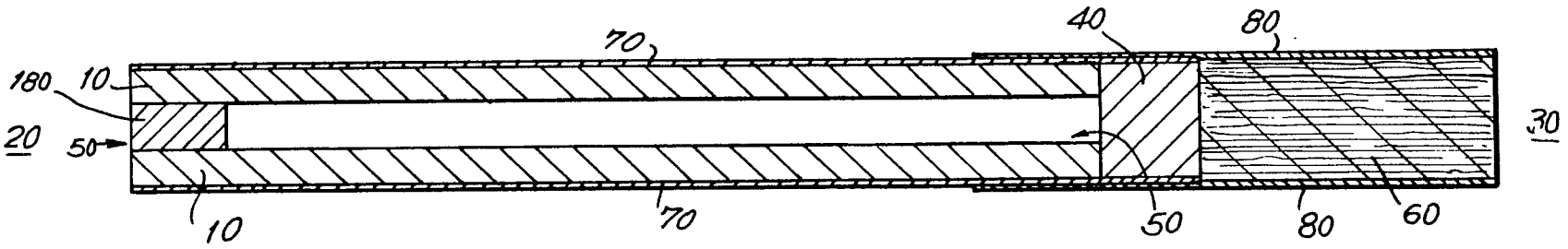
FIG. 1 shows a cross sectional view of smoking article in accordance with an embodiment of this invention.

The process of the present invention comprises three basic steps: a pyrolysis step, a controlled cooling step, and at least one additional process step selected from an oxygen absorption step, a water desorption step, and a salt impregnation and subsequent heat treatment step.

The pyrolysis step is carried out in an inert atmosphere in order to avoid combustion of the preformed article. Typically, the preformed ligno-cellulosic article is pyrolyzed in an oven which has controlled temperature zones and a quartz reaction chamber in which the articles to be pyrolyzed are placed. The quartz chamber is connected to a source of an inert gas, such as dry nitrogen or argon, and purged in order to remove the air. Throughout the process, a continuous flow of inert gas is passed through the quartz reaction chamber, hereinafter referred to as the pyrolyzing chamber, so that the inert atmosphere is continuously exchanged, whereby the volatiles driven off during pyrolysis are removed from the pyrolyzing chamber. This continuous exchange is believed to be important to the production of an essentially tasteless carbon heat source.

The article to be pyrolyzed is heated to a temperature within the range of from about 800° to about 1100° C., and more preferably from about 950° to about 1000° C., and is maintained at this temperature for from about 0.5 to about 3 hours, preferably from about 0.5 to about 1.5 hours, and more preferably from about 0.75 to about 1.25 hours. Typically, the inert gas employed is dry nitrogen and the flow rate through the pyrolyzing chamber is adjusted to within the range of from about 0.5 to about 5 liters per minute, preferably from about 1 to about 1.5 liters per minute, during pyrolysis. During pyrolysis, the ligno-cellulosic material generally experiences a weight loss of about 70% to about 80% and a dimensional shrinkage generally within the range of about 30% to about 35%.

Upon completion of pyrolysis, the pyrolyzed material is gradually cooled to a temperature within the range of from about 275° C. to about 25° C., preferably about 100° C. to about 25° C. Typical rate of cooling will be from about 500° to about 10° C. per hour, preferably from about 100° to about 60° C. per hour. It is important that the rate of cooling be gradual and controlled. It has been observed that a rapid quench, such as immersion in liquid nitrogen, will adversely affect the burn properties of the pyrolyzed material.

According to the oxygen absorption step, which functions to add oxygen to the pyrolyzed article, air or oxygen is gradually introduced into the inert gas stream as the temperature falls to within the range of from about 275° C. to about 25° C., preferably from about 100° C. to about 35° C. While oxygen absorption may be initiated at temperatures as high as 530° C. or as low as 25° C., it is preferred to operate within the above ranges. The oxygen is gradually introduced and the flow rate increased until the oxygen substantially replaces the inert gas. It is important to gradually introduce the oxygen as the cooling continues in order to avoid excessive oxidation of the pyrolyzed material. Preferably, the oxygen is introduced such that the ratio of the volume of nitrogen to the volume of oxygen is within the range of about 1:4 to about 8:1, most preferably about 4:1. During the oxygen absorption step, the pyrolyzed material is either at or is cooled to room temperature.

According to the impregnation and heat treatment step, the pyrolyzed article, which has been cooled to room temperature either with or without the oxygen absorption step, is first impregnated with an aqueous solution of salts of a cation selected from the group consisting of $K^+$, $Fe^{+2}$, $Fe^{+3}$, $Mg^{+2}$, $Mn^{+2}$, $Ca^{+2}$ and mixtures thereof. The pyrolyzed material is impregnated such that it contains from about 0.5 to about 11% of the cation on a dry weight basis, preferably from about 1% to about 3%. Any means known to those skilled in the art may be used to impregnate the pyrolyzed material with the salt solution. One particularly preferred means is vacuum impregnation. After impregnation, the material is then dried at a temperature within the range of from about 40° to about 100° C., preferably from about 50° to about 70° C., in vacuum.

The dried, impregnated, pyrolyzed material is then gradually heated to a temperature within the range of from about 550° to about 750° C., preferably to about 650° C., in an inert atmosphere and is maintained at this temperature for from about 5 to about 60 minutes, preferably from about 15 to about 30 minutes. The material is then cooled in the inert atmosphere.

According to the water desorption step, which, when employed, is preferably the final process step, the pyrolyzed article is subjected to a desiccant environment for at least about 8 hours preferably from about 12 hours to about 48 hours. The purpose of this step is to maintain an existing, or establish and maintain, a relatively moisture-free state in the carbon heat source. This step is preferably practiced by placing the pyrolyzed article in a desiccator containing $CaSO_4$. It has been observed that this process step improves the burn properties of the carbon heat source.

Any one or combination of the additional process steps may be employed. When salt impregnation and oxygen absorption are both employed, it is preferred that the oxygen absorption step follow the impregnation step.

As the ligno-cellulosic material, tobacco, peanut shells, coffee bean shells, paper, cardboard, bamboo, oak leaves, or a similar such material is suitably employed. The material may preferably be admixed with a binder, such as hydroxypropyl cellulose prior to formation into the desired shape.

The ligno-cellulosic material is preformed, prior to pyrolysis, into the shape desired upon completion of the pyrolysis and subsequent treatment steps, taking into account the dimensional shrinkage experienced during pyrolysis. Extrusion, rolling, injection-molding or the like may be employed to shape the article. Preferably, extruded, substantially tube-shaped articles with porous material located in the core of the tubes are employed. .The article, once pyrolyzed, must be sufficiently rigid to maintain the shape of the smoking article during smoking and must have a porosity sufficient to absorb the salt solution and oxygen, when employed, yet less porous than the material in the core, when present, so that the gaseous combustion products will flow through the central passage to the flavor source and not through the pyrolyzed material.

The present invention also relates to smoking articles comprising a flavor generator and a carbon heat source. The carbon heat source is the pyrolyzed material prepared according to the process of the present invention. While the carbon source may be prepared in any of the various commercially available shapes of smoking articles, the smoking article will be described with respect to a cigarette.

According to this embodiment, the smoking article is prepared by pyrolyzing a tube-shaped article of ligno-cellulosic material and then attaching the flavor generator adjacent the mouth end thereof. The tube-shaped carbon heat source may be formed with a porous, preferably open-cell foam, combustible material in the core, as by a co-extrusion process, or, preferably, with at least one porous, combustible plug disposed within the passage. When only one plug is employed, it is preferably disposed at the coal end of the cigarette to prevent flash jetting while the cigarette is being lit. When a porous core is employed, the core material is less dense than the surrounding tube-shaped material so that the combustion gases will flow through the central core to the flavor generator rather than through the carbon source. By selecting the type and amount of material placed in the passage, the temperature of the gases reaching the flavor generator can be established within a range such that thermally releasable flavorants are released without undergoing thermally induced decomposition to products which are not desirable as flavorants.

The flavor generator comprises a substrate material, such as alumina, magnesium hydroxide, zeolites, glass wool, charcoal, tobacco filler, fuller's earth, natural clays, and activated clays, which is impregnated with at least one thermally releasable flavorant, or which inherently contains at least one thermally releasable flavorant. The flavoring agent may consist of any suitable blend of natural or synthetic flavorants such as nicotine, glycerol, menthol, vanilla, eucalyptol, octyl acetate, orange, mint, or isoamyl isovalerate. The flavor generator is preferably cylindrical and of a diameter substantially equal to the diameter of the carbon source, and may be placed in abutting end-to-end relation to the carbon source or may be spaced therefrom. The carbon source and flavor generator may be wrapped in cigarette paper and, if desired, a conventional filter, such as cellulose acetate filter, may be placed after the flavor generator and joined thereto by tipping paper or the like. The flavor generator may comprise a flavored, foamed core containing readily volatilized flavors that are not subject to thermal degradation.

As the hot gases flow through the channel or bore in the carbon source and over the flavor generator, most of the flavors are distilled from the substrate material and the distillate is carried toward the smoker's mouth due to the drawing action. As the flavor-laden gases pass away from the flavor generator toward the cooler portion of the cigarette, the oils contained in the distillate recondense into relatively small droplets, forming a mist or aerosol, and pass into the mouth and nose of the smoker where they create a sensation by taste and smell. A sufficient amount of flavorant should be provided such that the flavorant is continuously released until the smoking article is extinguished.

When extruded tobacco articles are employed as the ligno-cellulosic material in the present process, they are preferably prepared according to the process disclosed in commonly assigned, Lanzillotti et al. U.S. Pat. No. 4,347,855, which is expressly incorporated herein.

Figure 2:
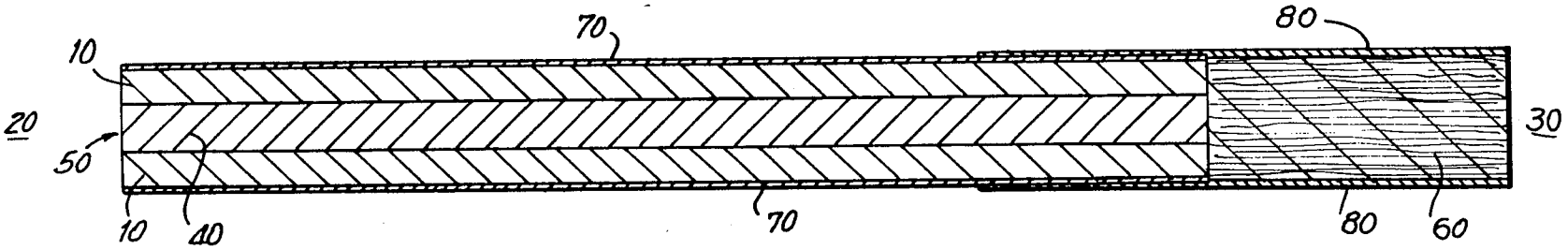
FIG. 2 shows a cross sectional view of an alternate embodiment of a smoking article in accordance with this invention.
Figure 3:
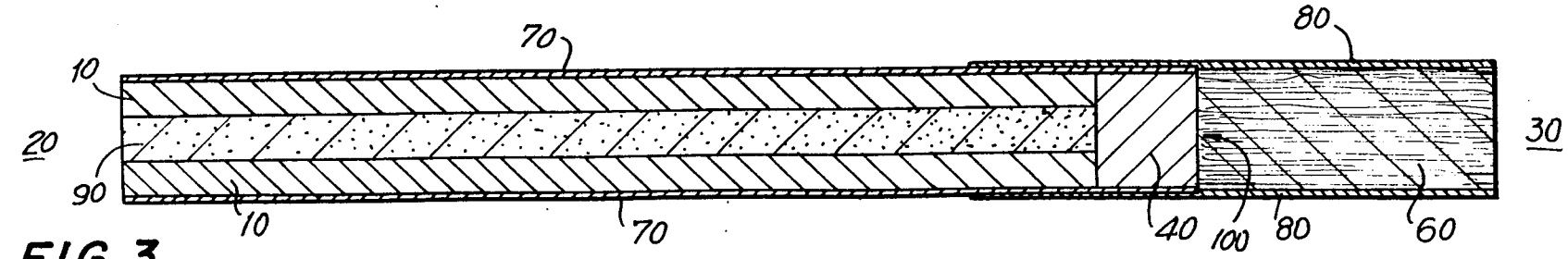
FIG. 3 shows a cross sectional view of an alternate embodiment of a smoking article in accordance with this invention.

Referring to FIG. 1, a smoking article in accordance with an embodiment of this invention comprises carbon heat source 10, having passage 50, flavor generator 40 disposed at mouth end 30 of carbon heat source 10, and plug 180 disposed at coal end 20 inside channel 50. The outside of carbon heat source 10 and flavor generator 40 are wrapped with cigarette paper 70. Filter 60 is disposed at mouth end 30 of carbon heat source 10 and joined thereto by tipping paper 80. FIG. 2 shows an alternate embodiment of a smoking article comprising carbon heat source 10, having flavor generator 40 being a porous substrate disposed axially in passage 50 and impregnated with a flavorant. Carbon heat source 10 is wrapped by cigarette paper 70. Filter 60 is disposed at mouth end 30 of carbon heat source 10 and joined thereto by tipping paper 80. FIG. 3 shows another embodiment wherein the smoking article comprises carbon heat source 10, porous combustible material 90 arranged inside passage 50 of carbon heat source 10, and flavor generator 40 disposed at mouth end 30 of carbon heat source 10. The outside of carbon heat source 10 and flavor generator 40 is wrapped by cigarette paper 70. Filter 60 is disposed at mouth end 100 of flavor generator 40 and joined thereto by tipping paper 80.

EXAMPLES

The following examples present illustrative but nonlimiting embodiments of the present invention. A comparative example is also presented.

In each of the following examples 1 through 9, extruded tobacco tubes prepared according to the method disclosed in U.S. Pat. No. 4,347,855 were employed as the preformed ligno-cellulosic material and were pyrolyzed in a Lindberg, 3-zone furnace having a chamber 6" in diameter and 36" long surrounding a quartz tube pyrolyzing chamber 5.3" in diameter and 52" long. The furnace was equipped with seven thermocouples spaced along the length of the quartz tube and could achieve a maximum temperature of about 1200° C.

EXAMPLE 1

Extruded tobacco tubes were prepared using −20+30 mesh particle size tobacco. Two sets of tobacco tubes were employed; one set had an outside diameter of 8 mm and an inside diameter of 5 mm, and the other had an outside diameter of 12 mm and an inside diameter of 5 mm. The tobacco tubes were pyrolyzed according to the procedure summarized below in Table 1.

TABLE 1

| Elapsed Time | Thermocouple Readings (°C.) | | | | | | | |
|---|---|---|---|---|---|---|---|---|
| (minutes) | 1 | 2 | 3 | 4 | 5 | 6 | 7 | Comments |
| 0 | | | | | | | | Tobacco tubes placed in quartz chamber and chamber purged with $N_2$ at a flow rate of 1 l/min. Furnace |
| 90 | 22 | 22 | 21 | 21 | 21 | 21 | 22 | turned on. |
| 97 | 52 | 97 | 94 | 78 | 94 | 95 | 59 | |
| 179 | 552 | 757 | 837 | 850 | 789 | 692 | 517 | |
| 190 | 597 | 803 | 880 | 891 | 829 | 733 | 573 | |
| 227 | 711 | 903 | 966 | 972 | 912 | 825 | 657 | |
| 258 | 752 | 917 | 967 | 972 | 917 | 840 | 684 | |
| 280 | 769 | 922 | 967 | 966 | 919 | 844 | 694 | |
| 285 | 772 | 924 | 969 | 967 | 920 | 846 | 697 | Furnace turned off. |
| 308 | 741 | 839 | 862 | 855 | 813 | 762 | 646 | |
| 321 | 712 | 796 | 815 | 806 | 767 | 721 | 613 | |
| 340 | 670 | 745 | 760 | 749 | 711 | 671 | 570 | |
| 350 | 649 | 721 | 735 | 723 | 687 | 648 | 550 | |
| 360 | 631 | 700 | 712 | 700 | 664 | 628 | 532 | |
| 370 | 612 | 679 | 691 | 678 | 643 | 607 | 514 | |
| 1347 | 103 | 120 | 123 | 114 | 105 | 31 | 99 | |
| 1354 | | | | | | | | Furnace lid lifted. |
| 1361 | 82 | 91 | 88 | 86 | 76 | 28 | 80 | |
| 1507 | 27 | 29 | 28 | 26 | 25 | 20 | 25 | |
| 1815 | 20 | 21 | 21 | 20 | 20 | 20 | 20 | |
| 1816 | | | | | | | | Gas flow changed from 1.05 l/min. of $N_2$ to 1.76 l/min. of air and $N_2$. The air/$N_2$ ratio was 700/1050 |
| 1821 | 20 | 20 | 21 | 20 | 20 | 19 | 20 | |
| 1826 | 20 | 20 | 21 | 20 | 20 | 19 | 20 | $N_2$ turned off; air intro- |
| 1831 | 20 | 20 | 21 | 20 | 20 | 19 | 20 | duced at a flow rate of |

TABLE 1-continued

| Elapsed Time (minutes) | Thermocouple Readings (°C.) 1 | 2 | 3 | 4 | 5 | 6 | 7 | Comments |
|---|---|---|---|---|---|---|---|---|
| 1846 | 20 | 21 | 21 | 21 | 20 | 20 | 20 | 0.75 l/min. |
| 1851 | 20 | 21 | 21 | 21 | 21 | 20 | 21 | |
| 1861 | 20 | 21 | 21 | 21 | 21 | 21 | 21 | Air flow turned off. |
| 1876 | 20 | 21 | 22 | 21 | 21 | 21 | 21 | |
| 2763 | 21 | 21 | 21 | 21 | 21 | 21 | 21 | |
| 2776 | | | | | | | | Pyrolyzed tobacco tubes removed from quartz chamber. |

The pyrolyzed samples were measured and weighed and it was determined that the samples experienced an average weight loss of 84.7%, an average decrease in length of 33.66%, an average decrease in outside diameter of 33.25%, and an average decrease in inside diameter of 33.05%. The pyrolyzed samples burned statically when lit. Static burning occurs when a cigarette rod continues to smoulder, once is has been lit, in the absence of air drafts and puff induced air flow.

EXAMPLE 2

Two sets of extruded tobacco tubes were pyrolyzed; one set had an outside diameter of 12 mm and an inside diameter of 5 mm, the other set had an outside diameter of 8 mm and an inside diameter of 2.5 mm. The tobacco tubes were pyrolyzed according to the procedure summarized below in Table 2.

TABLE 2

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in quartz chamber; $N_2$ purge initiated at 1.05 l/min. |
| 185 | | | | | | | | flow rate. Furnace turned |
| 187 | 24 | 25 | 25 | 25 | 26 | 26 | 26 | on. |
| 207 | 178 | 269 | 325 | 258 | 265 | 259 | 192 | |
| 279 | 546 | 670 | 762 | 759 | 680 | 607 | 468 | |
| 290 | 562 | 678 | 763 | 758 | 679 | 609 | 477 | |
| 317 | 589 | 691 | 765 | 755 | 677 | 614 | 487 | |
| 324 | 595 | 694 | 765 | 755 | 677 | 614 | 490 | |
| 349 | 609 | 700 | 769 | 752 | 675 | 615 | 494 | |
| 462 | 642 | 718 | 769 | 750 | 672 | 619 | 507 | |
| 465 | | | | | | | | Furnace turned off. |
| 483 | 619 | 668 | 696 | 675 | 603 | 564 | 491 | |
| 500 | 591 | 630 | 650 | 626 | 558 | 526 | 446 | |
| 1445 | 103 | 98 | 99 | 90 | 83 | 84 | 80 | $N_2$ flow rate increased to 4.2 l/min. |
| 1446 | | | | | | | | Furnace lid lifted. |
| 1467 | 62 | 59 | 58 | 54 | 47 | 47 | 46 | |
| 1494 | 44 | 45 | 46 | 42 | 41 | 37 | 37 | $N_2$ flow rate reduced to 1 l/min. |
| 1564 | 32 | 35 | 36 | 34 | 31 | 31 | 30 | |
| 1953 | | | | | | | | Air introduced at a flow rate of 1 l/min.; flow rate of air plus flow rate of $N_2$ = 2.05 l/min. |
| 1955 | 24 | 25 | 25 | 27 | 25 | 25 | 25 | |
| 1960 | 24 | 25 | 26 | 28 | 26 | 26 | 26 | |
| 1965 | 24 | 25 | 25 | 26 | 25 | 25 | 25 | |
| 2916 | 22 | 22 | 23 | 23 | 23 | 23 | 23 | |
| 3066 | | | | | | | | Air flow rate increased to 4 l/min; flow rate of air plus flow rate of $N_2$ = 5 l/min. |
| 3067 | 23 | 23 | 23 | 23 | 24 | 24 | 24 | |
| 3243 | 23 | 23 | 23 | 23 | 24 | 24 | 24 | |
| 3245 | | | | | | | | $N_2$ flow and air flow turned off; samples removed from quartz chamber. |

The pyrolyzed tobacco tubes evidenced a 72% weight loss and a 4 to 4.5% dimensional decrease for the larger diameter tubes and a 69% weight loss and 37.5% dimensional decrease for the smaller diameter tubes.

EXAMPLE 3

Extruded tobacco tubes were pyrolyzed according to the procedure summarized below in Table 3.

TABLE 3

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in quartz chamber; $N_2$ purge initiated at an $N_2$ flow |
| 1440 | | | | | | | | rate of 1.05 l/min. |

TABLE 3-continued

| Elapsed Time (minutes) | Thermocouple Readings (°C.) 1 | 2 | 3 | 4 | 5 | 6 | 7 | Comments |
|---|---|---|---|---|---|---|---|---|
| 1441 | 17 | 18 | 19 | 18 | 18 | 18 | 18 | Furnace turned on. |
| 1448 | 37 | 85 | 84 | 65 | 74 | 52 | — | |
| 1464 | 186 | 331 | 377 | 336 | 314 | 199 | 209 | |
| 1471 | 233 | 402 | 459 | 432 | 399 | 162 | 256 | |
| 1476 | 260 | 442 | 506 | 485 | 447 | 393 | 287 | |
| 1486 | 323 | 523 | 595 | 585 | 537 | 468 | 337 | |
| 1525 | 510 | 730 | 811 | 813 | 759 | 661 | 498 | |
| 1744 | 684 | 833 | 869 | 860 | 806 | 743 | 608 | |
| 1745 | | | | | | | | Furnace turned off. |
| 1751 | 678 | 811 | 839 | 829 | 771 | 718 | 600 | |
| 2079 | | | | | | | | $N_2$ flow rate increased to 2.3 l/min. |
| 2889 | 94 | 92 | 93 | 84 | 77 | 77 | 75 | $N_2$ flow rate increased to 2.6 l/min. |
| 2936 | 86 | 88 | 88 | 82 | 77 | 77 | 72 | Furnace lid lifted. |
| 3035 | 36 | 33 | 34 | 32 | 30 | 29 | 29 | |
| 3170 | 28 | 27 | 27 | 26 | 25 | 25 | 25 | |
| 3173 | | | | | | | | Air introduced at a flow rate of 1.05 l/min.; $N_2$ flow rate reduced to 1.05 l/min. |
| 3175 | 28 | 27 | 27 | 26 | 25 | 24 | 24 | |
| 3184 | 27 | 27 | 27 | 26 | 25 | 24 | 24 | |
| 3189 | | | | | | | | Air flow rate increased to 2 l/min. |
| 3192 | 27 | 26 | 27 | 26 | 25 | 24 | 24 | |
| 3198 | | | | | | | | Air flow rate increased to 3 l/min. |
| 3199 | 27 | 26 | 26 | 25 | 25 | 24 | 24 | |
| 3211 | 27 | 26 | 26 | 25 | 25 | 25 | 24 | |
| 3212 | | | | | | | | Air flow rate increased to 4 l/min. |
| 3215 | 26 | 26 | 26 | 25 | 25 | 24 | 24 | |
| 3220 | | | | | | | | $N_2$ turned off. |
| 3227 | 26 | 25 | 26 | 25 | 25 | 25 | 25 | |
| 3233 | 26 | 25 | 26 | 25 | 25 | 24 | 24 | |
| 3282 | 25 | 25 | 25 | 25 | 24 | 24 | 24 | |
| 3291 | | | | | | | | Pyrolyzed tobacco tubes removed from quartz chamber. |

The pyrolyzed tobacco tubes maintained a static burn when lit both before and after being placed in a desiccator containing $CaSO_4$ for about 48 hours. It was determined that the pyrolyzed tubes experienced a decrease in length of 27.24%, a decrease in outside diameter of 7.5%, and a decrease in inside diameter of 19.29%.

EXAMPLE 4

Two sets of extruded tobacco tubes were prepared; one set from tobacco material 60% of which was below 60 mesh and 40% of −20+30 mesh, and the other set from tobacco material 60% of which was below 60 mesh and 40% of −30+40 mesh. The tobacco tubes were 65 mm in length, and had an outside diameter of 8 mm and an inside diameter of 5 mm. The tobacco tubes were pyrolyzed according to the procedure summarized below in Table 4.

TABLE 4

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in quartz chamber; $N_2$ introduced at flow rate of 9 l/min. Furnace turned on. |
| 95 | | | | | | | | |
| 117 | 136 | 295 | 331 | 314 | 316 | 282 | 217 | |
| 147 | 247 | 509 | 595 | 607 | 573 | 492 | 368 | |
| 240 | 211 | 316 | 349 | 359 | 339 | 311 | 280 | |
| 318 | 459 | 724 | 820 | 851 | 803 | 722 | 572 | |
| 420 | 524 | 750 | 828 | 855 | 819 | 751 | 621 | |
| 437 | 526 | 749 | 826 | 853 | 818 | 751 | 622 | Furnace turned off. |
| 1381 | 52 | 67 | 70 | 70 | 67 | 67 | 66 | |
| 1443 | 48 | 62 | 64 | 64 | 62 | 62 | 61 | |
| 1506 | 45 | 56 | 58 | 59 | 57 | 57 | 56 | Furnace lid lifted. |
| 1528 | 34 | 37 | 39 | 42 | 39 | 38 | 39 | |
| 1670 | 24 | 26 | 27 | 28 | 27 | 27 | 27 | |
| 1684 | 24 | 26 | 27 | 27 | 27 | 27 | 27 | |
| 1685 | | | | | | | | Air introduced at a flow rate of 1 l/min. |
| 1696 | 24 | 26 | 27 | 27 | 26 | 26 | 26 | |
| 1832 | 24 | 26 | 27 | 27 | 26 | 26 | 26 | |
| 1887 | 24 | 24 | 25 | 25 | 25 | 25 | 25 | |

TABLE 4-continued

| Elapsed Time (minutes) | Thermocouple Readings (°C.) 1 | 2 | 3 | 4 | 5 | 6 | 7 | Comments |
|---|---|---|---|---|---|---|---|---|
| 2850 | | | | | | | | Pyrolyzed tobacco tubes removed from quartz chamber. |

Both sets of pyrolyzed tobacco tubes maintained a static burn.

EXAMPLE 5

Two sets of extruded tobacco tubes were prepared; one set from tobacco material 60% of which was −60 mesh and 40% was −30+40 mesh, and the other set from tobacco material 60% of which was −60 mesh and 40% was −20+30 mesh. The tobacco tubes had an outside diameter of 12 mm and an inside diameter of 7 mm. The tobacco tubes were pyrolyzed according to the procedure summarized below in Table 5.

TABLE 5

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in quartz chamber; $N_2$ introduced at flow rate of 1 l/min. Furnace turned on. |
| 7200 | 21 | 21 | 21 | 21 | 22 | 22 | 21 | |
| 7213 | 97 | 177 | 175 | 134 | 164 | 158 | 98 | |
| 7216 | 128 | 221 | 234 | 183 | 219 | 200 | 129 | |
| 7221 | 185 | 301 | 335 | 303 | 306 | 264 | 190 | |
| 7246 | 338 | 503 | 580 | 579 | 544 | 456 | 328 | |
| 7379 | 794 | 919 | 971 | 965 | 912 | 828 | 655 | |
| 7416 | 816 | 929 | 973 | 966 | 915 | 833 | 661 | |
| 7476 | 835 | 937 | 975 | 965 | 915 | 839 | 672 | Furnace turned off. |
| 7581 | 634 | 672 | 678 | 658 | 620 | 583 | 478 | |
| 7650 | 549 | 587 | 585 | 564 | 531 | 499 | 410 | |
| 8709 | 93 | 96 | 97 | 92 | 90 | 87 | 78 | |
| 8836 | 78 | 80 | 81 | 77 | 75 | 73 | 66 | |
| 8862 | 75 | 77 | 78 | 74 | 72 | 70 | 64 | |
| 8910 | 70 | 72 | 72 | 69 | 67 | 66 | 60 | Furnace lid lifted. |
| 8966 | 37 | 35 | 36 | 34 | 32 | 31 | 31 | |
| 9046 | | | | | | | | Air introduced at a flow rate of 4 l/min.; $N_2$ flow turned off. |
| 9048 | 29 | 29 | 29 | 27 | 26 | 26 | 25 | |
| 9079 | 28 | 27 | 28 | 26 | 25 | 26 | 25 | Samples removed from quartz chamber. |

Both sets of pyrolyzed tobacco tubes maintained a static burn.

EXAMPLE 6

Extruded tobacco tubes were pyrolyzed according to the procedure summarized below in Table 6.

TABLE 6

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in quartz chamber; $N_2$ introduced at a flow rate of 1 l/min. Furnace turned on. |
| 1335 | | | | | | | | |
| 1343 | 44 | 66 | 54 | 60 | 64 | 62 | 22 | |
| 1348 | 128 | 169 | 133 | 154 | 166 | 149 | 32 | |
| 1355 | 211 | 295 | 264 | 277 | 272 | 221 | 50 | |
| 1363 | 288 | 403 | 407 | 395 | 366 | 285 | 73 | |
| 1372 | 356 | 490 | 508 | 488 | 443 | 336 | 95 | |
| 1389 | 469 | 626 | 657 | 632 | 566 | 430 | 147 | |
| 1408 | 571 | 729 | 764 | 738 | 662 | 509 | 202 | |
| 1422 | 639 | 793 | 828 | 801 | 722 | 567 | 245 | |
| 1434 | 687 | 836 | 870 | 843 | 764 | 609 | 277 | |
| 1452 | 759 | 897 | 929 | 902 | 824 | 673 | 324 | |
| 1497 | 869 | 961 | 981 | 954 | 887 | 764 | 401 | |
| 1561 | 894 | 970 | 983 | 954 | 891 | 780 | 411 | Furnace turned off. |
| 1642 | 650 | 665 | 661 | 631 | 596 | 536 | 256 | |
| 1664 | 617 | 631 | 626 | 596 | 562 | 505 | 236 | |
| 1702 | 569 | 581 | 575 | 545 | 514 | 461 | 209 | |
| 1721 | 549 | 560 | 553 | 523 | 493 | 442 | 198 | |
| 1790 | 482 | 491 | 482 | 454 | 428 | 385 | 166 | |
| 2743 | 95 | 94 | 92 | 87 | 85 | 79 | 40 | Furnace lid lifted. |
| 2812 | 40 | 39 | 37 | 35 | 33 | 31 | 25 | |
| 2840 | 36 | 36 | 34 | 32 | 30 | 29 | 24 | |
| 2861 | 35 | 34 | 32 | 31 | 29 | 28 | 24 | |
| 2899 | 31 | 32 | 31 | 30 | 28 | 28 | 25 | |
| 2903 | | | | | | | | Air introduced at a flow rate of 4 l/min. |
| 2905 | | | 34* | | | | | Air flow turned off. |

TABLE 6-continued

| Elapsed Time (minutes) | Thermocouple Readings (°C.) 1 | 2 | 3 | 4 | 5 | 6 | 7 | Comments |
|---|---|---|---|---|---|---|---|---|
| 2959 | 29 | 29 | 29 | 28 | 27 | 26 | 24 | |
| 2965 | | | | | | | | Air introduced at a flow rate of 4 l/min. |
| 2970 | | | | | | | | $N_2$ flow turned off. |
| 3091 | 26 | 26 | 26 | 26 | 25 | 25 | 23 | |
| 3206 | 25 | 25 | 25 | 25 | 24 | 24 | 22 | Samples removed from quartz chamber. |

The samples were removed from the furnace and placed in a desiccator containing $CaSO_4$. The pyrolyzed tobacco tubes maintained a static burn.

EXAMPLE 7

Four sets of extruded tobacco tubes were prepared; one set from −30+40 mesh tobacco particles, a second set from −20 mesh tobacco particles, a third set from −20+30 mesh tobacco particles, and a fourth set from −20+30 mesh, recycled tobacco particles. The extruded tobacco tubes were pyrolyzed according to the procedure summarized below in Table 7.

TABLE 7

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Tobacco tubes placed in the quartz chamber; $N_2$ introduced at a flow rate of 1 l/min. Furnace turned on. |
| 1280 | | | | | | | | |
| 1281 | 23 | 25 | 24 | 25 | 25 | 25 | 21 | |
| 1290 | 121 | 149 | 119 | 134 | 141 | 130 | 25 | |
| 1300 | 271 | 336 | 324 | 324 | 301 | 244 | 48 | |
| 1311 | 378 | 473 | 479 | 462 | 417 | 323 | 82 | |
| 1322 | 454 | 567 | 584 | 562 | 501 | 382 | 112 | |
| 1348 | 584 | 716 | 744 | 717 | 639 | 495 | 175 | |
| 1423 | 841 | 951 | 968 | 939 | 874 | 754 | 362 | |
| 1447 | 896 | 1006 | 1019 | 989 | 928 | 811 | 397 | |
| 1457 | 882 | 954 | 965 | 934 | 883 | 791 | 404 | |
| 1467 | 899 | 985 | 996 | 964 | 910 | 809 | 402 | |
| 1485 | 890 | 972 | 979 | 949 | 900 | 819 | 402 | |
| 1487 | | | | | | | | Furnace turned off. |
| 1495 | 874 | 929 | 936 | 905 | 862 | 781 | 401 | |
| 1504 | 841 | 884 | 887 | 858 | 820 | 748 | 384 | |
| 1514 | 807 | 841 | 842 | 813 | 779 | 714 | 363 | |
| 1633 | 583 | 598 | 594 | 567 | 544 | 498 | 228 | |
| 1724 | 488 | 500 | 495 | 469 | 450 | 412 | 181 | |
| 1751 | 464 | 476 | 469 | 444 | 427 | 391 | 170 | |
| 1770 | 451 | 462 | 456 | 431 | 414 | 379 | 164 | |
| 2712 | 95 | 96 | 94 | 90 | 89 | 82 | 40 | Furnace lid lifted; $N_2$ flow rate increased to 3 l/min. |
| 2725 | 70 | 67 | 71 | 63 | 59 | 55 | 38 | |
| 2804 | 36 | 37 | 35 | 33 | 31 | 30 | 25 | |
| 2879 | 31 | 31 | 30 | 29 | 28 | 27 | 24 | |
| 2882 | | | | | | | | $N_2$ flow rate adjusted to 1 l/min.; air introduced at flow rate of 4 l/min. |
| 2885 | 31 | 31 | 31 | 28 | 27 | 27 | 24 | |
| 2917 | 30 | 30 | 29 | 27 | 26 | 26 | 24 | |
| 2937 | 29 | 29 | 28 | 27 | 26 | 26 | 24 | |
| 3042 | 27 | 27 | 26 | 26 | 25 | 25 | 24 | $N_2$ flow turned off. |
| 3182 | 25 | 25 | 25 | 25 | 24 | 25 | 24 | |
| 4187 | 22 | 22 | 23 | 22 | 22 | 22 | 22 | Samples removed from quartz chamber. |

It was determined that the pyrolyzed tobacco tubes experienced a weight loss in the range of 78% to 79%, and a dimensional decrease within the range of from about 27% to about 33%. All of the pyrolyzed tobacco tubes maintained a static burn.

EXAMPLE 8

Previously pyrolyzed tobacco tubes were vacuum impregnated with a saturated solution of either $KNO_3$, $Mg(CH_3COO)_2$, $FeCl_3$, $K_3C_6H_5O_7$, $FeCl_2$ or $MgCl_2$. The impregnated pyrolyzed tubes were dried in an oven in vacuum at 50° C., and then heat treated in the Lindberg furnace described above according to the procedure summarized below in Table 8.

TABLE 8

| Elapsed Time (minutes) | Thermocouple Readings (°C.) 1 | 2 | 3 | 4 | 5 | 6 | 7 | Comments |
|---|---|---|---|---|---|---|---|---|
| 0 | | | | | | | | Pyrolyzed tobacco tubes placed in quartz chamber; $N_2$ introduced at a flow rate of 1 l/min. |

TABLE 8-continued

| Elapsed Time (minutes) | Thermocouple Readings (°C.) 1 | 2 | 3 | 4 | 5 | 6 | 7 | Comments |
|---|---|---|---|---|---|---|---|---|
| 140 | 21 | 22 | 24 | 25 | 25 | 23 | 21 | Furnace turned on. |
| 146 | 74 | 71 | 93 | 91 | 102 | 48 | 24 | |
| 164 | 308 | 381 | 422 | 401 | 371 | 101 | 71 | |
| 176 | 403 | 495 | 545 | 521 | 464 | 119 | 116 | |
| 282 | 451 | 512 | 559 | 528 | 476 | 401 | 173 | |
| 331 | 564 | 624 | 665 | 638 | 574 | 490 | 242 | |
| 332 | | | | | | | | Furnace turned off. |
| 416 | 434 | 453 | 465 | 440 | 406 | 366 | 173 | |
| 428 | 421 | 438 | 448 | 424 | 392 | 354 | 166 | |
| 1374 | 88 | 88 | 85 | 82 | 79 | 74 | 38 | Furnace lid lifted. |
| 1414 | 43 | 46 | 43 | 38 | 36 | 35 | 29 | |
| 1477 | 33 | 35 | 32 | 30 | 28 | 28 | 25 | |
| 1482 | | | | | | | | Air introduced at a flow rate of 4 l/min. |
| 1483 | 33 | 34 | 32 | 30 | 28 | 28 | 25 | |
| 1484 | | | | | | | | $N_2$ flow turned off. |
| 1488 | 33 | 34 | 34 | 30 | 28 | 28 | 25 | |
| 1496 | 32 | 33 | 32 | 30 | 28 | 27 | 25 | |
| 1498 | | | | | | | | Air flow rate decreased to 2 l/min. |
| 1514 | 31 | 32 | 30 | 29 | 27 | 27 | 25 | |
| 1558 | 29 | 30 | 28 | 27 | 26 | 26 | 24 | |
| 1634 | 27 | 28 | 27 | 26 | 25 | 25 | 24 | Air flow rate decreased to 1 l/min. |
| 1750 | 25 | 25 | 25 | 25 | 24 | 24 | 23 | Air flow turned off. |
| 1835 | | | | | | | | Pyrolyzed tubes removed from quartz chamber. |

The salt treated, pyrolyzed tubes containing absorbed oxygen, maintained a static burn when ignited.

EXAMPLE 9

Extruded tobacco tubes were prepared from tobacco material of mesh size +60. The extruded tobacco tubes had an outside diameter of 12 mm, and an inside diameter of 5 mm and were pyrolyzed according to the procedure summarized below in Table 9.

TABLE 9

| Elapsed Time (minutes) | (Thermocouple Readings (°C.) 1 | 2 | 3 | 4 | 5 | 6 | 7 | Comments |
|---|---|---|---|---|---|---|---|---|
| | | | | | | | | Tobacco tubes placed in quartz chamber and chamber purged overnight in $N_2$ at a flow rate of 1 l/min. |
| 0 | | | | | | | | Furnace turned on |
| 1 | 23 | 24 | 24 | 24 | 24 | 24 | 24 | |
| 19 | 122 | 226 | 309 | 241 | 246 | 249 | 186 | |
| 31 | 215 | 343 | 456 | 499 | 410 | 365 | 280 | |
| 48 | 303 | 461 | 600 | 611 | 559 | 486 | 369 | |
| 57 | 347 | 516 | 664 | 681 | 625 | 544 | 415 | |
| 101 | 546 | 724 | 878 | 897 | 832 | 740 | 590 | |
| 161 | 733 | 870 | 973 | 979 | 909 | 839 | 711 | |
| 194 | 759 | 888 | 975 | 977 | 910 | 843 | 723 | |
| 229 | 775 | 900 | 977 | 977 | 907 | 846 | 731 | Furnace turned off |
| 300 | 630 | 708 | 722 | 712 | 655 | 624 | 557 | |
| 399 | 462 | 561 | 570 | 556 | 507 | 484 | 433 | |
| 448 | 412 | 509 | 518 | 503 | 457 | 437 | 393 | |
| 466 | 395 | 492 | 500 | 485 | 440 | 421 | 379 | |
| 1427 | 74 | 98 | 97 | 92 | 83 | 83 | 80 | Furnace lid raised |
| 1560 | 33 | 34 | 34 | 34 | 30 | 30 | 30 | Air flow introduced at a rate of 4 l/min. |
| 1564 | 32 | 33 | 34 | 36 | 31 | 31 | 31 | Air flow turned off |
| 1590 | 31 | 32 | 33 | 32 | 29 | 29 | 29 | Air flow turned on at a rate of 4 l/min. |
| 1599 | 31 | 31 | 32 | 31 | 29 | 29 | 29 | |
| 1652 | 29 | 29 | 29 | 29 | 27 | 27 | 27 | |
| 1770 | 26 | 26 | 27 | 26 | 25 | 25 | 25 | |
| 1829 | 25 | 25 | 26 | 26 | 25 | 25 | 25 | $N_2$ turned off |
| 1886 | 25 | 26 | 27 | 26 | 24 | 24 | 24 | |
| 2874 | 22 | 22 | 22 | 22 | 21 | 21 | 21 | Air flow turned off |
| 2885 | | | | | | | | Pyrolyzed tobacco tubes removed from quartz chamber |

The pyrolyzed samples were measured and weighed and it was determined that the samples experienced an average weight loss of 73.47%, and an average shrinkage loss of 31.41%. The samples would not sustain static burning.

The following example is comparative.

COMPARATIVE EXAMPLE 1

Extruded tobacco tubes were prepared from tobacco material of mesh size −20. The extruded tobacco tubes, which were 90 mm in length, with an outside diameter of 12 mm and an inside diameter of 10 mm, were pyrolyzed inside a quartz tube in the chamber of a Lindberg 55035-A oven. The oven was equipped with one thermocouple positioned over the center of the longitudinal axis of the tube. The procedure used is summarized below in Table 10.

TABLE 10

| Elapsed Time (Minutes) | Thermocouple Reading (°C.) | Comments |
|---|---|---|
| | | Tobacco tubes placed in quartz chamber and chamber purged with $N_2$ at a flow rate of 1.05 l/min overnight. |
| 0 | | Furnace turned on |
| 22 | 725 | |
| 118 | 920 | |
| 148 | 940 | |
| 162 | 950 | |
| 178 | 960 | |
| 196 | 960 | Furnace turned off |
| 205 | 960 | |
| 215 | 800 | |
| 220 | 740 | |
| 250 | 510 | |
| 265 | 440 | |
| 290 | 390 | |
| 313 | 390 | |
| 661 | 390 | Pyrolyzed tobacco tubes removed from quartz chamber. |

The pyrolyzed samples were removed from the chamber and quenched in liquid nitrogen. The samples were then weighed and measured, and it was determined that the samples experienced an average decrease in length of 31.6%, an average decrease in outside diameter of 28.29%, and an average decrease in inside diameter of 34%. The pyrolyzed samples would not sustain static burning.

We claim:

1. A process for producing a tasteless carbon heat source from a preformed article of ligno-cellulosic material, comprising pyrolyzing the article in a continuously exchanged inert atmosphere at a temperature within the range of from about 800° to about 1100° C. for from about 0.5 to about 3 hours, then cooling the pyrolyzed article in the inert atmosphere at a rate of from about 500° to about 10° C. per hour to a temperature within the range of from about 275° C. to about 25° C., and then adding oxygen to the pyrolyzed article.

2. The process of claim 1 wherein the ligno-cellulosic material is selected from the group consisting of cardboard, paper, bamboo, oak leaves and extruded tobacco.

3. A smoking article having a mouth end and a coal end comprising a substantially tube-shaped carbon heat source comprising preformed, ligno-cellulosic material pyrolyzed according to the process of claim 1, and a flavor generator, said heat source having a porosity sufficient to support combustion and a density such that puff induced air flow includes the combustion by-products and is through the tube, said flavor generator comprising a substrate material, adjacent the mouth end and in gaseous communication with puff induced air flow through the heat source tube, impregnated with at least one thermally releasable flavorant.

4. The smoking article of claim 3 wherein the substrate is selected from the group consisting of alumina, tobacco filler, magnesium hydroxide, zeolites, glass wool, charcoal, fuller's earth, natural clays, and activated clays.

5. A process for producing a tasteless carbon heat source from a preformed article of ligno-cellulosic material, comprising:

pyrolyzing the article in a continuously exchanged inert atmosphere at a temperature within the range of from about 800° to about 1100° C. for from about 0.5 to about 3 hours, then cooling the pyrolyzed article in the inert atmosphere at a rate of from about 500° to about 10° C. per hour to a temperature within the range of from about 275° C. to about 25° C., then adding oxygen to the pyrolyzed article, and then subjecting the pyrolized article to a desiccant environment.

6. A process for producing a tasteless carbon heat source from a preformed article of ligno-cellulosic material, comprising pyrolyzing the article in a continuously exchanged inert atmosphere at a temperature within the range of from about 800° to about 1100° C. for from about 0.5 to about 3 hours, then cooling the pyrolyzed article in the inert atmosphere at a rate of from about 500° to about 10° C. per hour to a temperature within the range of from about 275° C. to about 25° C., and then subjecting the pyrolyzed article to a desiccant environment.

7. The process of claim 6 wherein the ligno-cellulosic material is selected from the group consisting of cardboard, paper, bamboo, oak leaves and extruded tobacco.

8. A smoking article having a mouth end and a coal end comprising a substantially tube-shaped carbon heat source comprising preformed, ligno-cellulosic material pyrolyzed according to the process of claim 6, and a flavor generator, said heat source having a porosity sufficient to support combustion and a density such that puff induced air flow includes the combustion by-products and is through the tube, said flavor generator comprising a substrate material, adjacent the mouth end and in gaseous communication with puff induced air flow through the heat source tube, impregnated with at least one thermally releasable flavorant.

9. The smoking article of claim 8 wherein the substrate is selected from the group consisting of alumina, tobacco filler, magnesium hydroxide, zeolites, glass wool, charcoal, fuller's earth, natural clays, and activated clays.

10. The smoking article having a mouth end and a coal end and comprising a substantially tube-shaped carbon heat source comprising preformed, ligno-cellulosic material pyrolyzed according to the process of claim 3, a porous combustible material disposed within the passage, and a flavor generator, said heat source having a porosity sufficient to support combustion, and a density such that puff induced air flow is through the tube, said porous combustible material having a porosity greater than the porosity of the carbon heat source, said flavor generator comprising a substrate material, adjacent the mouth end, impregnated with at least one thermally releasable flavorant.

11. A process for producing a tasteless carbon heat source from a preformed article of ligno-cellulosic material, comprising pyrolyzing the article in a continuously exchanged inert atmosphere at a temperature within the range of from about 800° to about 1100° C. for from about 0.5 to about 3 hours, then cooling the pyrolyzed article in the inert atmosphere at a rate of from about 500° to about 10° C. per hour to a temperature of about 25° C., then contacting the pyrolyzed article with a salt solution comprising a salt of a cation selected from the group consisting of $K^+$, $Fe^{+3}$, $Fe^{+2}$, $Mg^{+2}$, $Mn^{+2}$, $Ca^{+2}$ and mixtures thereof, then drying the article at a temperature within the range of from about 50° to about 70° C. in vacuum, then gradually heating the article up to a temperature of about 650° C. in an inert atmosphere and maintaining said article at said temperature for from about 5 to about 60 minutes, and then cooling the article in said inert atmosphere at a rate of from about 500° to about 10° C. per hour to a temperature within the range of from about 275° C. to about 25° C.

12. The process of claim 11 including, after the second cooling step, adding oxygen to the pyrolyzed article.

13. The process of claim 12 including, as a final step, subjecting the pyrolyzed article to a desiccant environment.

14. The process of claim 11 including, as a final step, subjecting the pyrolyzed article to a desiccant environment.

15. The process of claim 11 wherein the pyrolyzed material is contacted with the salt solution by vacuum impregnation.

16. The process of claim 11 wherein the ligno-cellulosic material is selected from the group consisting of cardboard, paper, bamboo, oak leaves and extruded tobacco.

17. A smoking article having a mouth end and a coal end comprising a substantially tube-shaped carbon heat source comprising preformed, ligno-cellulosic material pyrolyzed according to the process of claim 4, and a flavor generator, said heat source having a porosity sufficient to support combustion and a density such that puff induced air flow includes the combustion by-products and is through the tube, said flavor generator comprising a substrate material, adjacent the mouth end and in gaseous communication with puff induced air flow through the heat source tube, impregnated with at least one thermally releasable flavorant.

18. The smoking article of claim 17 wherein the substrate is selected from the group consisting of alumina, tobacco filler, magnesium hydroxide, zeolites, glass wool, charcoal, fuller's earth, natural clays, and activated clays.

19. A smoking article having a mouth end and a coal end and comprising a substantially tube-shaped carbon heat source comprising preformed, ligno-cellulosic material pyrolyzed according to the process of claim 4, a porous, combustible material disposed within the passage, and a flavor generator, said heat source having a porosity sufficient to support combustion, a density such that puff induced air flow is through the tube, said porous combustible material having a porosity greater than the porosity of the carbon heat source, said flavor generator comprising a substrate material, adjacent the mouth end, impregnated with at least one thermally releasable flavorant.

20. A smoking article having a mouth end and a coal end and comprising a substantially tube-shaped carbon heat source comprising preformed, ligno-cellulosic material pyrolized according to a process for producing a tasteless carbon heat source from a preformed article of ligno-cellulosic material, comprising: pyrolyzing the article in a continuously exchanged inert atmosphere at a temperature within the range of from about 800° to about 1100° C. for from about 0.5 to about 3 hours, then cooling the pyrolyzed article in the inert atmosphere at a rate of from about 500° to about 10° C. per hour to a temperature within the range of from about 275° C. to about 25° C., then adding oxygen to the pyrolyzed article, a porous combustible material disposed within the passage, and a flavor generator, said heat source having a porosity sufficient to support combustion and a density such that puff induced air flow is through the tube, said porous combustible material having a porosity greater than the porosity of the carbon heat source, said flavor generator comprising a substrate material, adjacent the mouth end, impregnated with at least one thermally releasable flavorant.

21. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source during puff induced flow, the porosity being sufficient to sustain static combustion;

a flavor generator having a thermally releasable flavorant; and connector means for connecting the flavor generator and heat source in thermal and gaseous communication whereby the heat and gaseous combustion by-products from the carbon heat source are passed to the thermally releasable flavorant of the flavor generator to distill said flavorant and thereafter said distilled flavorant is delivered to the smoker by said gaseous combustion by-products generated during puff induced flow.

22. The article of claim 21 wherein the carbon heat source and flavor generator are disposed in an abutting end-to-end relationship and wherein the connector means further comprises one opening of the passage being adjacent to, abutting, and in open communication with one end of the flavor generator.

23. The article of claim 21 wherein the carbon heat source and flavor generator are disposed in an end to end relationship with an intervening space and wherein the connector means further comprises an outer wrapper for enclosing said space into a chamber and one opening of the passage being in open communication with the chamber.

24. The article of claim 21 wherein the carbon heat source further comprises pyrolyzed lignocellulosic material capable of sustaining static combustion and producing substantially tasteless combustion by-products.

25. The article of claim 21 further comprising a plug of porous combustible material disposed in the passage to prevent flash jetting while the article is being ignited.

26. The article of claim 21 wherein the flavor generator further comprises a substrate impregnated with at least one thermally releasable flavorant.

27. The article of claim 26 wherein the substrate further comprises a material selected from among alumina, magnesium, hydroxide, zeolites, glass wool, charcoal, tobacco filler, Fuller's earth, natural clays, activated clays and the like.

28. The article of claim 27 wherein the substrate further comprises a combination of tobacco filler and at least one other material selected from among alumina, magnesium hydroxide, zeolites, glass wool, charcoal, Fuller's earth, natural clays, activated clays and the like.

29. The article of claim 21 wherein the flavor generator further comprises a substrate inherently containing at least one thermally releasable flavorant.

30. The article of claim 29 wherein the substrate further comprises a material selected from among alumina, magnesium hydroxide, zeolites, glass wool, charcoal, tobacco filler, Fuller's earth, natural clays, activated clays and the like.

31. The article of claim 30 wherein the substrate further comprises a combination of tobacco filler and at least one other material selected from among alumina, magnesium hydroxide, zeolites, glass wool, charcoal, Fuller's earth, natural clays, activated clays and the like.

32. The article of claim 21 wherein the flavor generator and the carbon heat source are substantially cylindrical.

33. The article of claim 32 wherein the cylindrical generator has a diameter substantially equal to the carbon heat source.

34. The article of claim 21 further comprising a filter adjacent to the flavor generator.

35. The article of claim 21 further comprising aerosol means for causing said distilled flavorant to form an aerosol.

36. The article of claim 35 wherein the aerosol means further comprises the flavor generator having a length sufficient to permit the distilled flavorant to cool and condense into an aerosol or mist as the flavorant is passed through the flavor generator during inhalation.

37. The smoking article of claim 21 wherein said heat source further comprises a length not greater than about 47.5 mm prior to smoking.

38. The smoking article of claim 21 wherein said heat source further comprises a length not greater than about 65 mm prior to smoking.

39. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source during puff induced flow;

a flavor generator having a thermally releasable flavorant, said flavor generator being a relatively porous combustible material disposed in the passage of the carbon heat source; and connector means for connecting the flavor generator and heat source in thermal and gaseous communication whereby the heat and gaseous combustion by-products from the carbon heat source are passed to the thermally releasable flavorant of the flavor generator to distill said flavorant and thereafter said distilled flavorant is delivered to the smoker by said gaseous combustion by-products during puff induced flow.

40. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, and porosity being sufficient to sustain static combustion;

a flavor generator having a thermally releasable flavorant; and connector means for connecting the flavor generator and heat source in thermal and gaseous communication wherein the carbon heat source and flavor generator are disposed in an abutting end to end relationship and one opening of the passage being adjacent to, abutting and in open communication with one end of the flavor generator whereby the heat and gaseous combustion by-products from the carbon heat source are passed to the thermally releasable flavorant of the flavor generator to distill said flavorant for delivery to the smoker.

41. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, the porosity being sufficient to sustain static combustion;

a flavor generator having a thermally releasable flavorant; and connector means for connecting the flavor generator and heat source in thermal and gaseous communication wherein the carbon heat source and flavor generator are disposed in an end to end relationship with an intervening space and an outer wrapper for enclosing said space into a chamber and one opening of the passage being in open communication with the chamber whereby the heat and gaseous combustion by-products from the carbon heat source are passed to the thermally releasable flavorant of the flavor generator to distill said flavorant for delivery to the smoker.

42. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, the porosity being sufficient to sustain static combustion;

a flavor generator having a thermally releasable flavorant;

connector means for connecting the flavor generator and heat source in thermal and gaseous communication whereby the heat and gaseous combustion by-products from the carbon heat source are passed to the thermally releasable flavorant of the flavor generator to distill said flavorant for delivery to the smoker; and a plug of porous material disposed in the passage to prevent flash jetting while the article is being ignited.

43. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, the porosity being sufficient to sustain static combustion;

a flavor generator having a substrate impregnated with at least one thermally releasable flavorant wherein the substrate further comprises a combination of tobacco filler and at least one other material selected from among alumina, magnesium hydroxide, zeolites, glass wool, charcoal, Fuller's earth, natural clays, activated clays, and the like; and connector means for connecting the flavor generator and heat source in thermal and gaseous communication whereby the heat and gaseous combustion by-products from the carbon heat source are passed to the thermally releasable flavorant of the flavor generator to distill said flavorant for delivery to the smoker.

44. A smoking article comprising:

a carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, the porosity being sufficient to sustain static combustion;

a flavor generator having a substrate inherently containing at least one thermally releasable flavorant wherein the substrate further comprises a combination of tobacco filler and at least one other material selected from among alumina, magnesium hydroxide, zeolites, glass wool, charcoal, Fuller's earth, natural clays, activated clays, and the like; and connector means for connecting the flavor generator and heat source in thermal and gaseous communication whereby the heat and gaseous combustion by-products from the carbon heat source are passed to the thermally releasable flavorant of the flavor generator to distill said flavorant for delivery to the smoker.

45. A smoking article comprising:

a substantially cylindrical carbon heat source adapted for combustion and heat generation having a passage for the thermal and gaseous by-products of combustion to flow through the heat source, said heat source being a relatively nonporous material so that gaseous combustion by-products are substantially passed through the passage and not through the heat source, the porosity being sufficient to sustain static combustion, the heat source having a first diameter;

a substantially cylindrical flavor generator having a thermally releasable flavorant the flavor generator having a diameter substantially equal to the first diameter; and connector means for connecting the flavor generator and heat source in thermal and gaseous communication whereby the heat and gaseous combustion by-products from the carbon heat source are passed to the thermally releasable flavorant of the flavor generator to distill said flavorant for delivery to the smoker.

* * * * *